BEST AVAILABLE COPY

United States Patent [19]

Churchman et al.

[11] Patent Number: 5,044,443

[45] Date of Patent: Sep. 3, 1991

[54] METHOD AND APPARATUS FOR PRODUCING WELLS

[75] Inventors: Ronald K. Churchman, Carrollton; Roddie R. Smith, Plano, both of Tex.

[73] Assignee: Otis Engineering Corporation, Dallas, Tex.

[21] Appl. No.: 569,073

[22] Filed: Aug. 17, 1990

[51] Int. Cl.[5] ..... E21B 34/10

[52] U.S. Cl. ..... 166/386; 166/321; 166/332

[58] Field of Search ..... 166/374, 382, 386, 387, 166/369, 151, 185, 321, 325, 332, 334

[56] References Cited

U.S. PATENT DOCUMENTS

| | | | |
|---|---|---|---|
| 4,063,593 | 12/1977 | Jessup | 166/321 X |
| 4,105,075 | 8/1978 | Helmus | 166/321 |
| 4,566,478 | 1/1986 | Denton | 166/332 X |
| 4,633,952 | 1/1987 | Ringgeberg | 166/336 |
| 4,711,305 | 12/1987 | Ringgenberg | 166/336 |
| 4,766,960 | 8/1988 | Williamson, Jr. | 166/321 |

*Primary Examiner*—William P. Neuder

*Attorney, Agent, or Firm*—M. H. Gay

[57] ABSTRACT

A subsurface slide valve and flapper valve controlled by a single actuator responsive to control pressure from the surface. A shifting tool landable in a landing nipple and in response to pressure in the tubing first extending dogs to contact the actuator and then shifting the dogs downwardly to move the actuator to valve open position.

8 Claims, 4 Drawing Sheets

FIG.2B
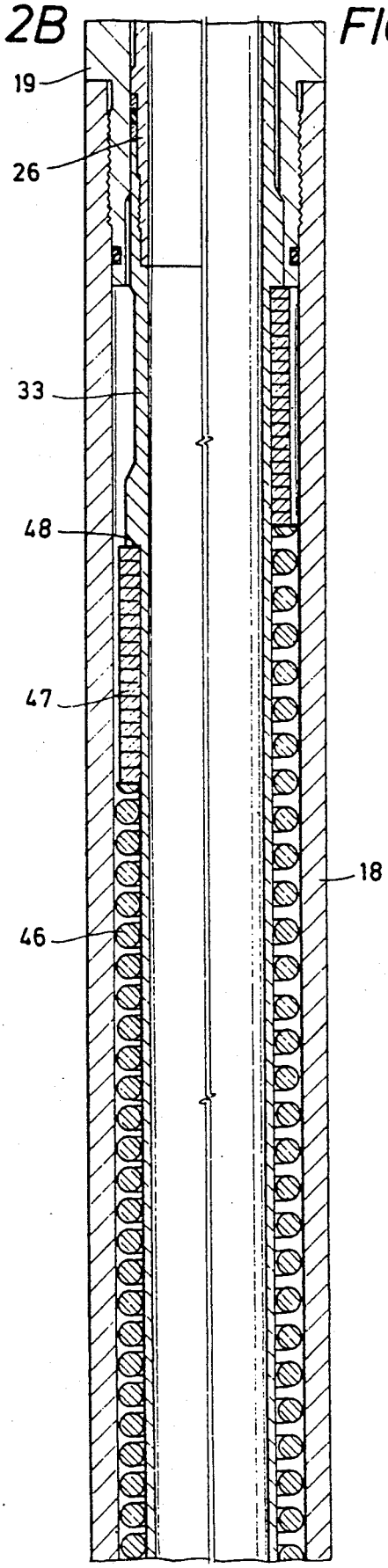
FIG.3B
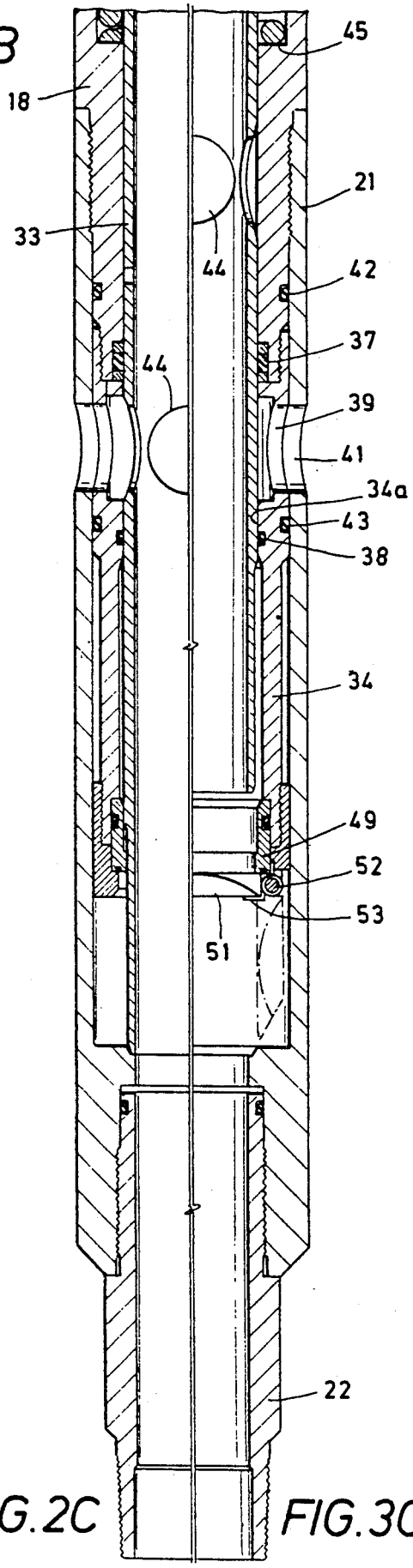
FIG.2C FIG.3C

BEST AVAILABLE COPY

METHOD AND APPARATUS FOR PRODUCING WELLS

This invention relates to method and apparatus for producing wells and particularly to producing gas storage wells.

Gas storage wells have been produced in the past through the casing-tubing annulus and the tubing. Such production has been through two separate control valves such as shown in U.S. Pat. No. 4,842,074.

Shifting of a valve actuator by a shifting tool responsive to tubing pressure is a known art as shown by U.S. Pat. No. 4,276,937. A shifting tool having longitudinally spaced expansible dogs is shown in U.S. Pat. No. 4,723,606. These dogs cannot move toward and away from each other.

An object of this invention is to provide a method of operating a production system in which the system may be operated after failure of seals of the valve members or loss of normal control of the valve actuator while maintaining maximum flow area through the smallest flow area of the valve.

Another object is to provide a single valve for controlling flow through a tubing and flow into a casing-tubing annulus.

Another object is to provide a single valve for controlling flow through a tubing and flow into a casing-tubing annulus and a shifting tool for engaging the actuator of the valve at its upper end so that the actuator may provide for maximum flow area through the actuator.

Another object is to provide a shifting tool for shifting the actuator of a valve by engaging the upper end of the actuator.

Another object is to provide a shifting tool which may be landed in a latch mandrel, then have dogs extended and then move said dogs downwardly relative to the latch mandrel to shift a valve member.

Another object is to provide a system for flowing a well through the tubing and the tubing-casing annulus in which flow may be controlled after failure of any of the tubing valve, the tubing-casing annulus valve and the pressure operated system for shifting the valve actuator.

Other objects, features and advantages of this invention will be apparent from the specification, drawings, and claims.

In the drawings, wherein an illustrative embodiment is shown and wherein like numerals indicate like parts:

FIG. 1 is a view partly is section and partly in elevation of equipment for practicing this invention;

FIG. 2A, 2B, and 2C are quarter section continuation views of the valve of this invention in open position;

FIG. 3A, 3B, and 3C are quarter section continuation views of the valve of this invention in closed position with the open position of the flapper shown in dashed lines;

Figure 1:
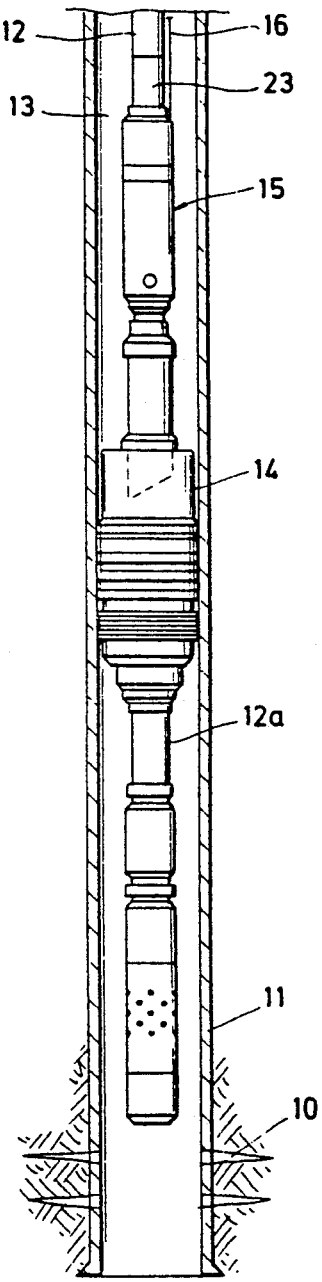

FIG. 1 illustrates a formation 10 which may be a gas storage formation having a casing 11. Within the casing is a production tubing **12—12*a* resulting in a casing-tubing annulus 13. The tubing communicates with a packer 14** which may be of conventional design.

The valve of this invention is indicated generally at 15. The valve 15 is normally controlled by pressure fluid in control conduit 16. The pressure fluid is supplied from the surface in the normal manner of surface controlled, subsurface valves.

Figures 2A, 3A:
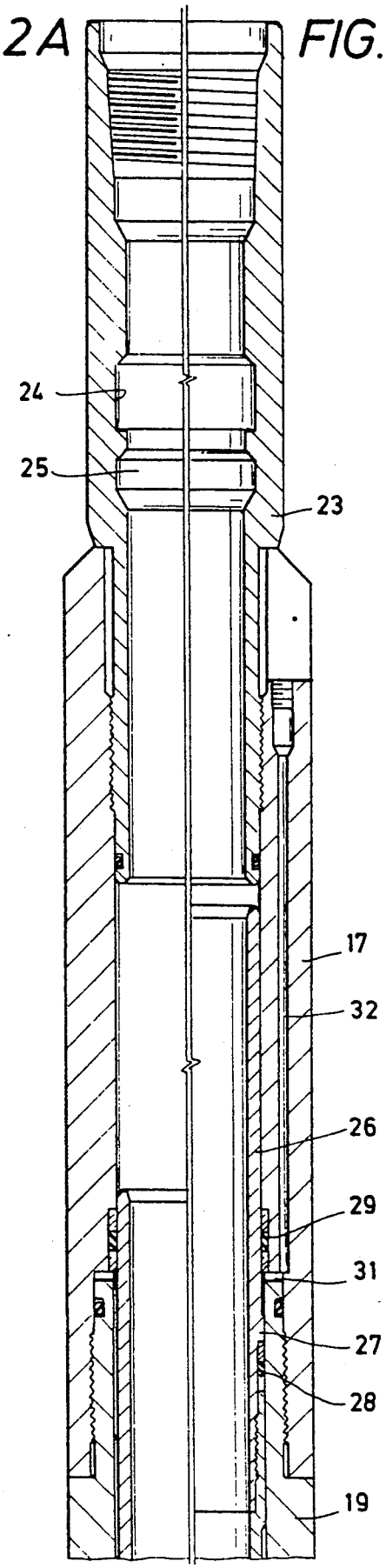

FIGS. 2 and 3 illustrate the valve of this invention. The tubular valve body includes the top section 17 joined to the spring section 18 by connecting nipple 19. Depending from the spring section is a valve section 21 to which is connected a bottom nipple 22.

Attached to the upper end of the valve body is a landing nipple 23 providing with latch grooves 24 and 25 for locating tools such as a shifting tool.

Within the body a tubular valve actuator 26 is reciprocally mounted. The actuator may be in several sections as shown and carries a piston 27. Seal means 28 on the piston and 29 in the top body section 17 define a pressure chamber 31 for receiving pressure fluid through passageway 32 and control line 16 (FIG. 1) extending to the surface for controlling operation of the valve actuator.

A tubular slide valve member 33 depends from the actuator 26 and cooperates with a slide valve seat 34 carried in the valve body section 21 to control flow through the side wall of the valve body. Seals 37 and 38 are carried by the valve seat 34 and straddle ports 39 in the sidewall of the valve seat which align with ports 41 in the body valve section. Suitable seals 42 and 43 are provided between the valve seat and body to straddle the ports 39–41 and prevent flow thereby. The valve member 33 has ports 44 which register with ports 39 and 41 when the actuator is in the down position to open the valve to flow from the lower section **12*a* of the tubing into the tubing-casing annulus 13** and thence to the surface.

Bottomed on a shoulder 45 in spring housing 18 is a return spring 46 urging the actuator in an upwardly direction. A plurality of spacer washers 47 extend between the top of the spring and a downwardly facing shoulder 48 on the valve member 33.

Closure valve means are also provided to control flow into the lower end of the valve body. This means is preferably a flapper design. The lower end of the valve seat 34 is provided with a flapper valve seat 49. A flapper valve member 51 is carried by the valve seat and swings about pivot 52. A spring 53 urges the flapper valve toward engagement with the seat. The flapper valve member 51 lies in the path of travel of the valve member 33 when it is shifted downwardly, and movement of the valve member to its down position moves the flapper valve member 51 to its open position. If desired the closure valve means could be positioned above the slide valve.

Figure 4:
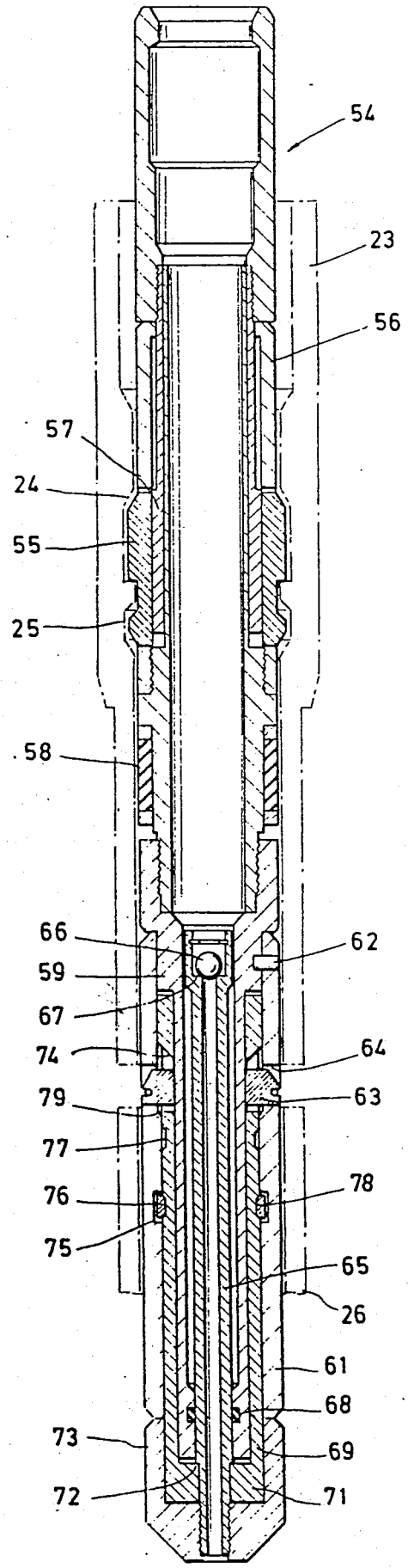
FIG. 4 is a sectional view of the shifting tool of this invention landed in a fragment of the valve of this invention shown in dashed lines.
Figure 6:
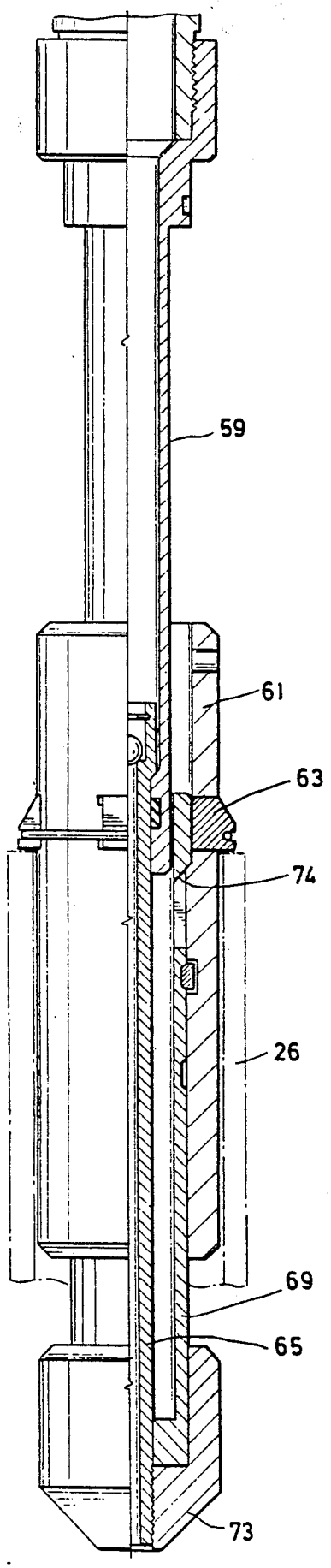
FIG. 6 is a view similar to FIG. 5 with the shifting dogs shifted downwardly to move the actuator to valve open position.
Figure 5:
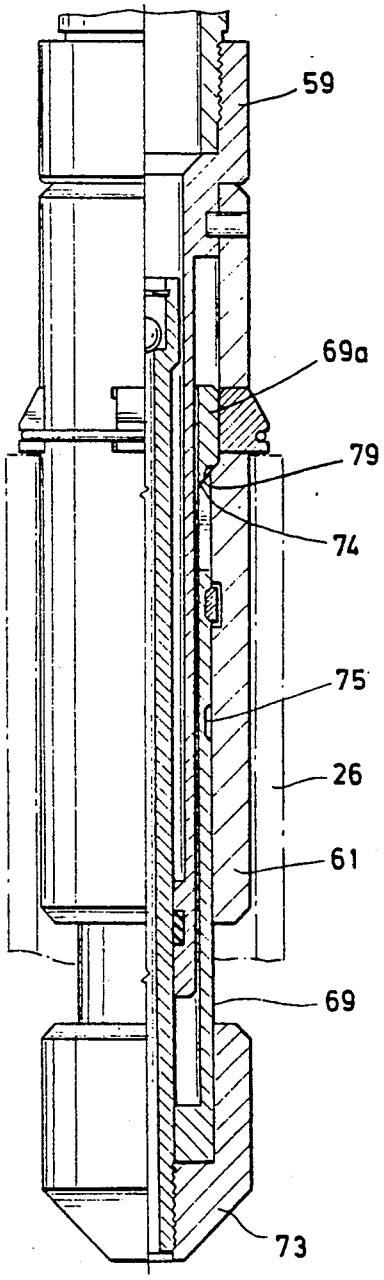
FIG. 5 is a view partly in elevation and partly in quarter section similar to FIG. 4 with the shifting dogs extended above the actuator of the valve.

A shifting tool embodying this invention is shown in FIGS. 4, 5 and 6. The tool includes at its upper end a latch means indicated generally at 54 for releasably securing the tool in the landing nipple 23. The latch is well known and may take any desired form such as the latch shown in U.S. Pat. No. 4,276,937. The latch shown includes keys 55 carried by a mandrel 56 and expanded by a cone like bevel (not shown) on the lower end of expander 57. The mandrel 56 carries a seal 58 for sealing with a polished bore in the landing nipple 23.

Depending from the latch 54 is a tubular mandrel 59. A sleeve 61 is telescoped over the mandrel 59 and is releasably attached to the mandrel by a shear pin 62. A plurality of dogs 63 are carried in slots 64 in the sleeve.

Extending through the mandrel 59 is an inner actuator tube 65 having its lower end exposed to fluid therebelow to avoid a fluid lock while running the tool. In the upper end of the tube 65 is a check valve provided by a ball 66 cooperable with an upwardly facing seat 67 preventing downward flow of fluids through the tool. A seal 68 is provided between the inner actuator tube and the mandrel 59.

The inner actuator tube 65 carries an outer actuator tube 69 by clamping an inturned flange 71 on the outer tube between a downwardly facing shoulder 72 on the inner tube and a nut 73 threaded on to the lower end of the inner tube 65. The outer actuator tube reciprocates in an annulus between the mandrel 59 and the sleeve 61. The outer actuator tube has cone like surfaces 74 for expanding the dogs 63 with downward movement of the outer actuator tube.

The inner surface of the sleeve 61 is grooved at 75 to receive a detent ring 76 which cooperates with grooves 77 and 78 in the outer actuator tube to detent the tube in these two locations.

In operation the valve actuator 26 is normally reciprocated upwardly by the upward force exerted by spring 46 in response to low pressure conditions in chamber 31 and downwardly in response to high pressure conditions in chamber 31 in the conventional manner. The actuator simultaneously controls both valve members 33 and 51.

When it is desired to control the valve actuator 26 by tubing pressure the shifting tool is run in the conventional manner such as by wire line releasably secured in the upper end of the latch mandrel 54. After the lock mandrel lugs 55 have been extended to lock the tool in the landing nipple, and the wire line preferably retrieved, the tool components will be in the position illustrated in FIG. 4 with the shifting dogs 63 positioned above the valve actuator 26.

With the shifting tool latched in position pressure in the tubing is increased and exerts a downward force on the inner actuator tube 65. This initial increase in tubing pressure above the tool overcomes the resistance of detent ring 76 and shifts the inner and outer actuator tubes 65 and 69 downwardly to the position shown in FIG. 5. In moving downward the outer actuator tube moves the cone surfaces 74 behind dogs 63 and extends them to overly the upper end of the valve actuator. At this time the boss 69*a* on the actuator 69 holds the dogs in extended position and the detent ring 76 engages groove 77 to detent the parts in the FIG. 5 position. Also the cone surfaces 74 engage an upwardly facing shoulder 79 on sleeve 61. The force required to shift the actuator tube downwardly from first position shown in FIG. 4 to the second dog extended position shown in FIG. 5 is less that the force exerted by valve spring 46.

With the dogs extended the pressure in the tubing is increased to shear pin 62 releasing the sleeve 61 from mandrel 59. When the force exerted by pressure above the shifting tool exceed the force exerted by spring 46 the inner and outer actuator tubes are moved from the second position of FIG. 5 to the third position shown in FIG. 6. As the dogs are move downwardly they engage the upper end of the valve actuator 26 and move the actuator downward to move both valve members to open position. There after reduction of pressure in the tubing permits the spring 46 to return the actuator to the up position resulting in closing of both valves.

In gas storage control valves it is desirable to provide for maximum flow area through the control valves. If the valve actuator is designed to have grooves to receive dogs its wall thickness is increased. This is not necessary with the shifting tool of this invention as the dogs engage the top of the actuator.

From the above it will be seen that flow through the tubing and tubing-casing annulus are controlled by a single valve. If desired the tubing can be plugged and tubing pressure utilized to control flow through the tubing-casing annulus. In the event of loss of control through the control line the shifting tool can be landed and flow continued through the annulus. In the event of failure of the flapper seal the shifting tool can be landed and production continued through the annulus. If control line operation is lost and the flapper seal is out the shifting tool can be landed and flow continued with control by the slide valve.

The foregoing disclosure and description of the invention are illustrative and explanatory thereof and various changes in the size, shape and materials, as well as in the details of the illustrated construction, may be made within the scope of the appended claims without departing from the spirit of the invention.

What is claimed is:

1. A valve comprising:

a body having a flowway therethrough, ports through the side wall of the body, a slide valve member and seat controlling flow through the ports, a reciprocal actuator for shifting said slide valve member between open and closed position, a piston on said actuator exposed to a chamber for receiving pressure fluid from exterior of the body and urging the actuator toward slide valve member open position, resilient means for urging the actuator toward slide valve member closed position, a second valve seat in the body and around said flowway, and a second valve member cooperable with said second valve seat and in the path of said slide valve member and moved to the open position by the slide valve member when said actuator is in the slide valve open position.

2. The valve of claim 1 wherein the second valve is a flapper and the valve and its seat are at the lower end of the body.

3. A shifting tool comprising, latch means for latching the tool in a tubing, seal means on the tool for sealing the exterior of the tool with a polished bore in a tubing, a tubular mandrel attached to the latch means, an actuator tube reciprocal in said tubular mandrel, seal means between said actuator tube and mandrel, a check valve preventing downward flow through the actuator tube, a sleeve slidable along said mandrel, means releasably attaching said sleeve to said mandrel, a plurality of dogs carried by said sleeve, means for extending said dogs in response to movement of said actuator downward from a first to a second position, and means moving said sleeve downward with movement of said actuator tube from said second to a third position.

4. The tool of claim 3 wherein means releasably holds said actuator in its first position.

5. A shifting tool comprising, latch means for latching the tool in a tubing, seal means on the tool for sealing the exterior of the tool with a polish bore in a tubing, a tubular mandrel attached to the latch means, an actuator tube reciprocal within said mandrel, seal means between said mandrel and tube, a check valve preventing downward flow though said actuator tube, a sleeve slidable along said mandrel, a plurality of dogs carried by said sleeve, cone means carried by said actuator tube for extending said dogs with downward movement of said actuator tube from a first to a second position, detent means releasable holding said cone means in its first position, an upwardly facing shoulder on said sleeve engagable by said cone means with said dogs in fully extended position, and shear means between said mandrel and sleeve releasably attaching said sleeve to said mandrel and shearing upon downward movement of said sleeve shoulder relative to said mandrel.

6. The tool of claim 5 wherein said detent means releasably holds said cone means in said second position.

7. A valve and shifting tool therefor: said valve comprising:

a body having a flowway therethrough, a landing nipple having internal locating groove means attached to the upper end of said body, ports through the side wall of the body, a slide valve member and seat controlling flow through the ports, a reciprocal actuator having an upwardly facing shoulder for shifting said slide valve member between open and closed position, a piston on said actuator exposed to a chamber for receiving pressure fluid from exterior of the body and urging the actuator toward slide valve member open position, resilient means for urging the actuator toward slide valve member closed position, a second valve seat in the body and around said flowway, and a second valve member cooperable with said second valve seat and in the path of said slide valve member and moved to the open position by the slide valve member when said actuator is in the slide valve open position;

said shifting tool comprising:

latch means for latching the tool in said locating grooves, seal means on the tool for sealing the exterior of the tool with a polished bore in a tubing, a tubular mandrel attached to the latch means, an actuator tube reciprocal in said tubular mandrel, seal means between said actuator tube and mandrel, a check valve preventing downward flow through the actuator tube, a sleeve slidable along said mandrel, means releasably attaching said sleeve to said mandrel, a plurality of dogs carried by said sleeve, means for extending said dogs in response to movement of said actuator downward from a first to a second position, said dogs when extended positioned over said shoulder on the actuator of said valve, and means moving said sleeve downward with movement of said actuator tube from said second to a third position.

8. The method of controlling flow in the tubing and casing-tubing annulus of a gas storage well wherein a packer seals between a casing and tubing in the well, and a valve having a slide valve controlling flow between the tubing and casing-tubing annulus and a second valve controlling flow through the tubing in response to shifting a spring loaded actuator controlled by pressure in a control line comprising;

controlling pressure in said control line to shift said actuator to control flow through said tubing and casing-tubing annulus, landing a shifting tool in sealing relationship with said valve, increasing pressure in said tubing to engage vertically reciprocal dogs on said shifting tool with said actuator, and controlling pressure in said tubing above said shifting tool to reciprocate said dogs and said actuator to open and close said slide and second valves.

* * * * *